US005474479A

United States Patent [19]

Bennett et al.

[11] Patent Number: 5,474,479

[45] Date of Patent: Dec. 12, 1995

[54] LOUVERED CONTACT ELECTRICAL CONNECTOR

[75] Inventors: Glenn E. Bennett, Glendale; Michael Furbacher; Robert K. Grebe, both of Scottsdale; Dennis E. Petrie, Gilbert, all of Ariz.

[73] Assignee: The Whitaker Corporation, Wilmington, Del.

[21] Appl. No.: 314,016

[22] Filed: Sep. 28, 1994

[51] Int. Cl.[6] ..... H01R 13/187

[52] U.S. Cl. ..... 439/843

[58] Field of Search ..... 439/843, 786, 439/787, 851

[56] References Cited

U.S. PATENT DOCUMENTS

| | | | |
|---|---|---|---|
| 2,422,265 | 6/1948 | Squires | 40/615 |
| 3,161,451 | 12/1964 | Neidecker | 439/843 |
| 3,453,587 | 7/1969 | Neidecker | 439/843 |
| 3,538,491 | 11/1970 | Longenecker et al. | 439/851 |
| 3,861,776 | 1/1975 | Deal | 439/843 |
| 4,039,238 | 8/1977 | Johnson, Jr. et al. | 439/843 |
| 4,662,706 | 5/1987 | Foley | 439/843 |
| 4,749,357 | 6/1988 | Foley | 439/80 |
| 5,033,982 | 7/1991 | Lucas | 439/750 |
| 5,078,622 | 1/1992 | Hunt, III et al. | 439/589 |
| 5,082,462 | 1/1992 | Oswald, Jr. | 439/851 |
| 5,340,338 | 8/1994 | Sai et al. | 439/845 |

FOREIGN PATENT DOCUMENTS

| | | | |
|---|---|---|---|
| 2632851 | 4/1977 | Germany | 439/851 |

*Primary Examiner*—Gary F. Paumen
*Attorney, Agent, or Firm*—Robert J. Kapalka

[57] ABSTRACT

An electrical connector comprises a generally cylindrical tube member (10) having a tube wall (12) and an electrically conductive body (22) having a plurality of louvers (24) in a generally tubular array. The body and the tube member are nested one within the other, with the louvers having respective sides (28) projecting away from the tube wall for engagement with a complementary connector. The body and the tube member are secured against relative axial movement in at least one direction by at least one extruded projection (40) of the tube wall.

19 Claims, 3 Drawing Sheets

LOUVERED CONTACT ELECTRICAL CONNECTOR

FIELD OF THE INVENTION

The invention relates to an electrical connector of the type wherein a louvered metal contact is housed in a sleeve, and more particularly, to a device for retaining the louvered contact in the sleeve.

BACKGROUND OF THE INVENTION

A known type of electrical connector for conducting high electrical currents comprises a sleeve or tube element which houses a contact having a plurality of louvers formed in a tubular array. The louvers project radially inwardly for engagement with the peripheral surface of a complementary plug-type connector. Insertion and removal of the complementary connector generates frictional forces on the louvered contact which tend to axially displace the contact in the sleeve, and the contact must be secured against inadvertent displacement or withdrawal therefrom.

U.S. Pat. No. 3,453,587 discloses an electrical connector including a sleeve having an interior surface with a counterbored recess. A louvered metal contact disposed in the recess is confined between opposed annular shoulders of the recess. Although this arrangement is effective for securing the louvered contact within the sleeve, forming the counterbored recess requires a machining operation which increases the cost of the finished connector.

U.S. Pat. No. 3,861,776 discloses a connector including a louvered metal contact which has a plurality of teeth at opposite ends of thereof. The teeth are inclined radially outwardly with respect to the axis of the contact so that the teeth will engage the inner surface of a surrounding sleeve. This arrangement lacks an abutment for positively securing the louvered contact within the sleeve, and it is possible that the contact will slip axially during connector mating and unmating.

There is a need for an economical and reliable arrangement for securing a louvered metal contact to the body of a plug or jack in an electrical connector.

SUMMARY OF THE INVENTION

It is an object of the invention to provide an economical louvered contact-type electrical connector.

It is another object of the invention to secure a louvered contact to the body of a plug or jack in an electrical connector.

It is a further object of the invention to simplify construction of a louvered contact-type electrical connector.

These and other objects are accomplished by an electrical connector comprising a generally cylindrical tube member having a tube wall, and an electrically conductive body having a plurality of louvers in a generally tubular array. The body and the tube member are nested one within the other, with the louvers having respective sides projecting away from the tube wall for engagement with a complementary connector. The body and the tube member are secured against relative axial movement in at least one direction by at least one extruded projection of the tube wall.

In another embodiment the electrical connector comprises an electrically conductive body including a pair of spaced, annular bands having a common central axis. A plurality of annularly spaced louvers extending between the bands have respective sides projecting radially inwardly of the bands for engagement with a complementary connector. The body has axially spaced apart ends defining a body length, and the body is disposed within a tube member having a tube wall and a radially inner surface extending axially for a tube length which is greater than the body length. The body is secured against withdrawal from the tube member in at least one axial direction by a first projection set comprising at least one radially inward projection of the radially inner surface.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENT

Figure 1:
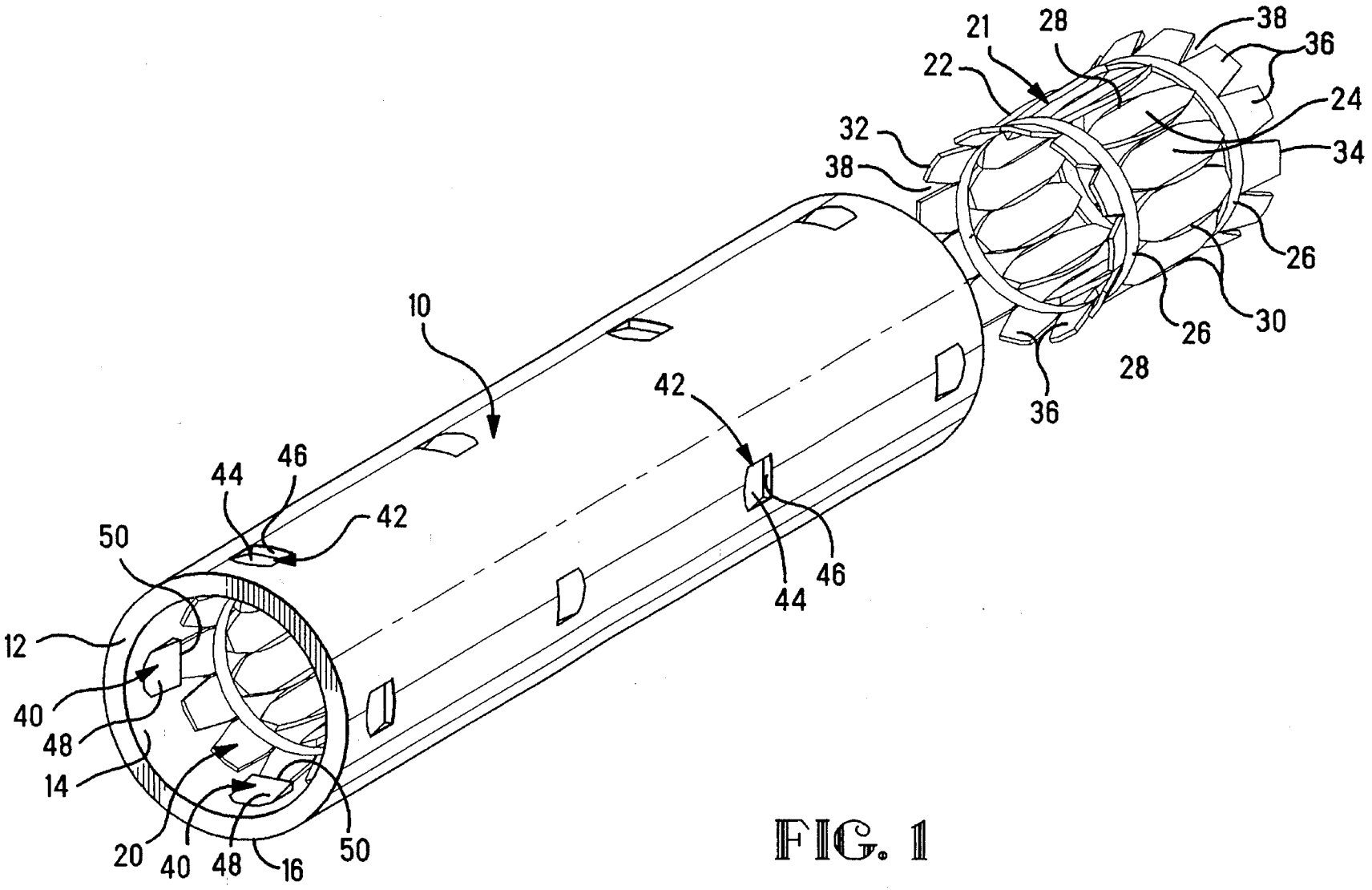
FIG. 1 is an isometric view of a jack-type electrical connector according to the invention, with one louvered contact exploded away.
Figure 2:
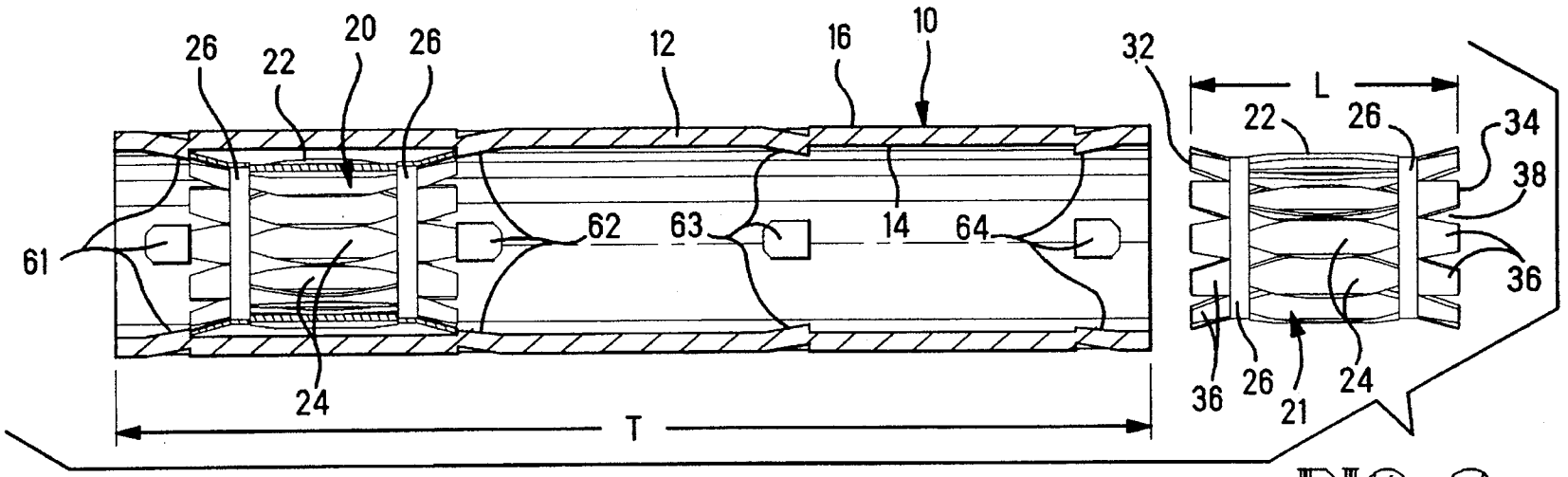
FIG. 2 is a longitudinal cross-sectional view of the jack-type electrical connector of FIG. 1.

There is shown in FIGS. 1 and 2 an electrical connector according to the invention which includes a tube member 10 and two louvered contacts 20 and 21 which are normally nested coaxially within the tube member 10 at opposite ends thereof, the louvered contact 21 being shown exploded out of the tube member 10 for clarity. The tube member 10 has a tube wall 12 which is bounded by inner surface 14 and outer surface 16. The tube member 10 is illustrated as having a circular cross-section, although other cross-sectional shapes such as rectangular, square or oval are considered to be within the scope of the invention.

Figure 3:
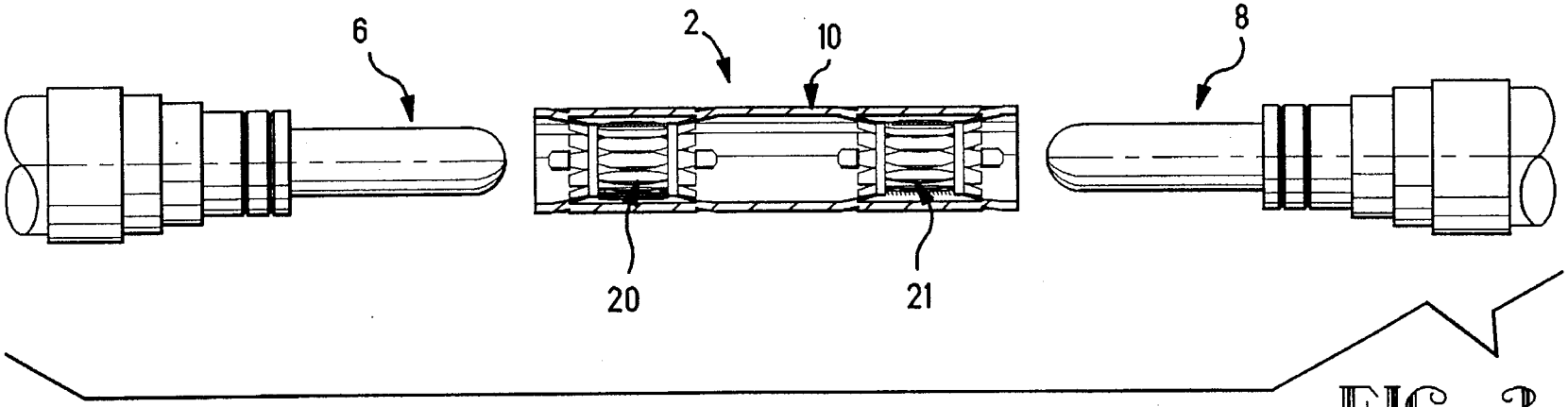
FIG. 3 is a longitudinal cross-sectional view of the jack-type electrical connector and a pair of complementary plug-type connectors.

In one embodiment as shown in FIG. 3, the electrical connector according to the invention is a jack-type coupling 2 which matingly receives two complementary plug-type connectors 6 and 8. In the illustrated embodiment the tube member 10 is electrically conductive and each of the louvered contacts 20 and 21 is engageable with a respective one of the complementary connectors 6 and 8 to provide an electrical coupling therebetween. In another embodiment the tube member 10 may be terminated to the end of a conductive cable and have a single one of the louvered contacts 20, 21 so as to comprise a jack-type terminal which receives one of the complementary plug-type terminals 6 or 8. Alternately, an electrical coupling according to the invention may comprise a tube member which is electrically insulative and has a single louvered contact which is engageable with a pair of complementary connectors inserted from opposite ends of the tube member.

The louvered contacts 20 and 21 are of a type which is known in the art in many variations for use in high current-carrying electrical connectors. Details of the structure and method of making this type of louvered contact in several variations are disclosed in U.S. Pat. Nos. 3,453,587; 3,861,776; and 4,039,238, all of which are incorporated by reference as if set forth fully herein.

Figure 4:
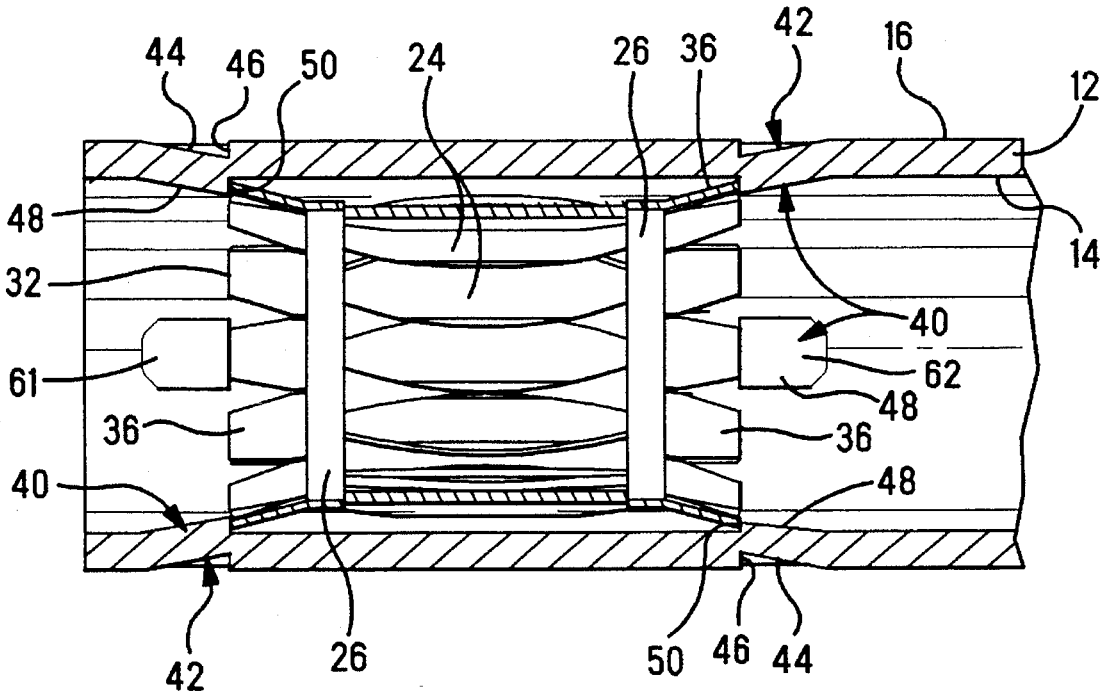
FIG. 4 is an enlarged cross-sectional view of the jack-type electrical connector and a louvered contact disposed therein.

With reference to FIGS. 1, 2 and 4, each of the louvered contacts 20 and 21 comprises an electrically conductive body 22 having a plurality of louvers 24 in a generally tubular array about a central axis. The body 22 may be formed from a strip of electrically conductive material which is stamped, bent, and rolled to a desired shape. The body 22 includes a pair of spaced, annular bands 26 having a common central axis which is coaxial with the central axis of the louvers 24. Material between the bands 26 is apertured to form the plurality louvers 24 which extend between the bands 26 and are annularly spaced apart. The louvers 24 are bent or twisted about their longitudinal axes so that the louvers extend obliquely to the bands 26. The louvers 24 have respective side edges 28 which project radially inwardly of the bands 26, and respective opposite side edges 30 which project radially outwardly of the bands 26. The body 22 may be circumferentially closed such as by abutting together circumferential ends of the rolled strip with or without soldering of the ends, or the body may have a circumferential gap between ends of the rolled strip.

The body 22 has an axial length L extending between opposite ends 32 and 34. Portions adjacent the ends 32 and 34 are preferably flared radially outwardly as the portions extend from the bands 26 toward the respective ends 32 and 34 so that the ends 32 and 34 will securely engage projections of the tube member 10 as will be more fully described hereinafter. The flared end portions preferably include a plurality of prongs or teeth 36 which permit flaring of the end portions without unduly stretching and thinning the material of the end portions.

The louvered contacts 20 and 21 are nested within the tube member 10 and are secured against relative axial displacement by engagement with projections 40 which are arrayed in first, second, third and fourth projection sets 61, 62, 63, 64, respectively, each of the projection sets comprising a circumferential array of four projections 40 spaced 90° apart. The projections 40 are formed with a suitable indenting tool which makes indentations 42 in the outer surface 16 so as to extrude, or lance, the projections 40 from the inner surface 14. Each of the projections 40 has a circumferential span which is greater than a gap 38 between adjacent ones of the teeth 36, and it is preferred that each of the projections 40 span several teeth. Each of the indentations 42 preferably has a decline ramp 44 and a substantially transverse wall 46. The resulting projections 40 of the inner wall 14 are each wedge-shaped with a lead-in ramp 48 and an abutment wall 50. The lead-in ramps 48 enable the louvered contacts to be slidably inserted into the tube member 10 in one axial direction, i.e., the louvered contact 20 is insertable through the left hand end of the tube member 10, and the louvered contact 21 is insertable through the right hand end. The abutment walls 50 prevent withdrawal of the louvered contacts in the other axial direction.

As shown in FIG. 2, the inner surface 14 of the tube member 10 extends axially for a tube length T which is greater than the body length L. Although it is preferred that the projections 40 be formed by extruding material of the tube wall 12, the projections 40 may be raised protuberances of the surface 14 without departing from the scope of the invention.

The projection sets 61 and 62 have their respective abutment walls 50 axially spaced apart by a distance substantially equal to the body length L of the louvered contact 20. During insertion of the louvered contact 20 into the tube member 10 from the left hand end thereof, some of the teeth 36 at the end 34 are deflected radially inwardly as they ride over the lead-in ramps 48 of the projection set 61, the deflected teeth then springing back after they pass beyond the abutments 50 of the projection set 61. Further insertion of the louvered contact 20 brings some of the teeth 36 at the end 34 into engagement with the abutment walls 50 of the projection set 62, while simultaneously some of the teeth 36 at the end 32, having been radially deflected by the lead-in ramps 48 of the projection set 61, spring back and become trapped behind the abutment walls 50 of the projection set 61. The contact 20 is thereby confined between the projections 40 of the sets 61 and 62.

The projections 40 are dimensioned to be sufficiently high so as to prevent overcompression, yielding and set of the louvers 24 when either of the mating connectors 6, 8 is axially offset due to radially directed loading. The projection height, number of projections and their circumferential extent is selected to restrict the approach of the mating connectors 6 and 8 toward the tube wall 12 so that the louvers 24 are protected from damage. However, the projections 40 are not so high as to interfere with insertion and withdrawal of the mating connectors 6 and 8.

Although the invention has been shown and described with reference to a jack-type connector wherein the louvered contact is nested within the tube member, it will be appreciated by those skilled in the art that the invention may also be embodied in a plug-type connector wherein the louvered contact is nested exteriorly on the tube member and the projections extend radially outwardly from the tube wall. It should also be appreciated that although the invention has been shown and described with reference to sets of four circumferentially spaced projections, more or less than four projections but at least one projection may be employed to secure the contact in any one axial direction.

It is an advantage of the invention that a louvered contact can be axially secured within a tube member by projections extending from a wall of the tube member. It is a further advantage that the projections can be extruded from the tube wall.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical connector comprising:

an electrically conductive body including a pair of spaced, annular bands having a common central axis, a plurality of annularly spaced louvers extending between the bands and having respective sides projecting radially inwardly of the bands for engagement with a complementary connector, the body being disposed within a tube member having a tube wall, the body being secured against withdrawal from the tube member in at least one axial direction by a first projection set comprising at least one radially inwardly extruded projection of the tube wall.

2. The connector according to claim 1, wherein the first projection set comprises a plurality of extruded projections disposed in a circumferential array.

3. The connector according to claim 1, further comprising a second projection set comprising at least one other radially inwardly extruded projection, the first and second projection sets are axially spaced apart, and the body is axially confined between the projection sets.

4. The connector according to claim 3, wherein the first and second projection sets are axially spaced apart by a distance substantially equal to an axial length of the body.

5. The connector according to claim 1, wherein an axial end portion of the body is flared radially outwardly.

6. The connector according to claim 5, wherein the flared end portion comprises multiple teeth extending from one of the bands.

7. The connector according to claim 6, wherein an end of at least one of the teeth is engageable with the at least one projection.

8. An electrical connector comprising:

an electrically conductive body including a pair of spaced, annular bands having a common central axis, a plurality of annularly spaced louvers extending between the bands and having respective sides projecting radially inwardly of the bands for engagement with a complementary connector, the body having axially spaced apart ends defining a body length, the body being disposed within a tube member having a tube wall and a radially inner surface extending axially for a tube length which is greater than the body length, the body being secured against withdrawal from the tube member in at least one axial direction by a first projection set comprising at least one radially inward projection of the radially inner surface which is formed by an extrusion of the tube wall inwardly beyond the inner surface.

9. The connector according to claim 8, further comprising a second projection set comprising at least one other radially inward projection, the first and second projection sets are axially spaced apart, and the body is axially confined between the projection sets.

10. The connector according to claim 9, wherein the first and second projection sets are axially spaced apart by a distance substantially equal to the body length.

11. The connector according to claim 8, wherein an axial end portion of the body is flared radially outwardly.

12. The connector according to claim 11, wherein the flared end portion comprises multiple teeth extending from one of the bands.

13. The connector according to claim 12, wherein an end of at least one of the teeth is engageable with the at least one projection.

14. An electrical connector comprising:

a generally cylindrical tube member having a tube wall, and an electrically conductive body having a plurality of louvers in a generally tubular array, the body being nested within the tube member, the louvers having respective sides projecting away from the tube wall for engagement with a complementary connector, the body and the tube member being secured against relative axial movement in at least one direction by a first projection set comprising at least one extruded projection of the tube wall.

15. The connector according to claim 14, wherein the first projection set comprises a plurality of extruded projections disposed in a circumferential array.

16. The connector according to claim 14, further comprising a second projection set comprising at least one other extruded projection, the first and second projection sets are axially spaced apart, and the body is axially confined between the projection sets.

17. The connector according to claim 16, wherein the first and second projection sets are axially spaced apart by a distance substantially equal to an axial length of the body.

18. The connector according to claim 14, wherein an axial end portion of the body is flared radially outwardly.

19. The connector according to claim 18, wherein the flared end portion comprises multiple teeth extending from one of the bands.

* * * * *